US006132487A

United States Patent [19]

Mori

[11] Patent Number: 6,132,487

[45] Date of Patent: Oct. 17, 2000

[54] MIXED POWDER FOR POWDER METALLURGY, SINTERED COMPACT OF POWDER METALLURGY, AND METHODS FOR THE MANUFACTURING THEREOF

[75] Inventor: Hideyuki Mori, Ibaraki-Ken, Japan

[73] Assignee: Nikko Materials Company, Limited, Japan

[21] Appl. No.: 09/437,913

[22] Filed: Nov. 9, 1999

[30] Foreign Application Priority Data

Nov. 11, 1998 [JP] Japan ..... 10-335023

[51] Int. Cl.[7] ..... B22F 3/00

[52] U.S. Cl. ..... 75/247; 75/255; 419/1; 419/57

[58] Field of Search ..... 75/247, 255; 419/1, 419/57

[56] References Cited

U.S. PATENT DOCUMENTS

| | | | |
|---|---|---|---|
| 3,969,084 | 7/1976 | Watanabe et al. . | |
| 5,077,005 | 12/1991 | Kato | 420/469 |
| 5,429,876 | 7/1995 | Tanaka et al. | 428/553 |
| 5,441,555 | 8/1995 | Matthews et al. | 75/255 |
| 5,637,160 | 6/1997 | Brock et al. | 148/434 |
| 5,938,864 | 8/1999 | Tomikawa et al. | 148/435 |

FOREIGN PATENT DOCUMENTS

| | | |
|---|---|---|
| 59-64731 | 4/1984 | Japan . |
| 5-190240 | 7/1993 | Japan . |

OTHER PUBLICATIONS

English Abstract of the Japanese Laid Open No. 5–190240.

English Abstract of the Japanese Laid Open No. 59–64731.

*Primary Examiner*—Ngoclan Mai

*Attorney, Agent, or Firm*—Howson and Howson

[57] ABSTRACT

A mixed metallurgical powder is provided containing powdered copper used for the manufacture of sintered structural parts such as brushes. A sintered compact made of the mixed metallurgical powder and a method for the manufacture of the sintered compact are also provided. The powder and the sintered compact are provide with an extremely high corrosion resistance because, preferably, the mixed metallurgical powder contains powdered copper and 20–400 ppm by weight of Bi in the form of powdered Bi.

12 Claims, No Drawings

MIXED POWDER FOR POWDER METALLURGY, SINTERED COMPACT OF POWDER METALLURGY, AND METHODS FOR THE MANUFACTURING THEREOF

FIELD OF THE INVENTION

The present invention relates generally to powder metallurgy and, in particular, to a mixed powder containing powdered copper used for manufacturing sintered structural parts such as brushes, a sintered compact using such mixed powder, and a method for manufacturing such a sintered compact. More particularly, the present invention relates to a mixed metallurgical powder and a sintered compact thereof having excellent corrosion resistance, and to its method of manufacture.

BACKGROUND OF THE INVENTION

Mixed copper powder produced by adding graphite, or the like, to powdered copper is widely used in the manufacture of mechanical parts, such as, sintered oil-less bearings, or brushes. For example, electric brushes include a metal-graphite brush produced by powder metallurgy. The metal component mainly comprises copper to which a low-melting-point metal is added to facilitate sintering and improve corrosion resistance. Copper-coated graphite powder forms a structure having continuous copper, and is used for producing a brush having excellent sintering properties, electrical conductivity, and mechanical strength. Copper-based materials including 5–10% by weight of graphite are also used as braking friction materials.

In general, since powdered copper, or mixed powder containing copper, used in these applications will rust (be oxidized), it is treated with an organic anti-corrosion agent, such as benzotriazole, before being stored or shipped.

However, since such organic anti-corrosion agents decompose, or gasify, at temperatures above 300–400° C., when the above anti-corrosion treated powdered copper or mixed powder is sintered, the anti-corrosion effect is lost, and thereafter, the sintered compact rusts (is oxidized) when it is exposed to the air similar to copper in a powdered state.

Heretofore, powdered copper, or mixed powder containing copper, has been treated only before sintering as described above with no other special treatment.

For example, Japanese Patent Laid-Open No. 5-190240 discloses a method for manufacturing an electric brush by sintering powdered electrolytic copper, ie. ultra-fine powdered copper of an average particle diameter of 15 um or less, and graphite. This reference discloses that the oxidation resistance of the brush is little affected and that the corrosion resistance effect is passive. However, the reason for the corrosion resistance effect is unclear and not disclosed.

Since the sintered compact (electric brush) of the above-referenced application has exposed copper, it is reasonable that the problem of rust (oxidation) cannot be avoided. Since an electric brush constitutes a part of an electric device or a mechanical component installed in a corrosive environment such as in a factory or, in some cases, outdoors, the problem of rust is significant.

Although non-analogous to the field of powder metallurgical technique, Japanese Patent Laid-Open No. 59-64731 discloses a technique for improving electrical conductivity, softening resistance (heat resistance), and corrosion resistance by melting and casting copper to which Pb is added. This technique is carried out by the above-described melting method, and the above-stated enhanced characteristics were achieved by alloying Pb evenly throughout the entire cast structure. However, the treatment or handling of a sintered compact made from a powdered copper, or mixed powder containing copper, or the behavior or effect of Pb in a sintered compact is not known or disclosed by the above identified application.

As described above, a consistent solution for the problem of rust (oxidation) of powdered copper or mixed powder containing copper, and the problem of the rust of sintered compacts produced therefrom is not provided by the prior art. Heretofore, since rust prevention has been applied individually by methods such as the treatment of powdered copper with an organic anti-corrosion agent, there have been problems of inefficiency and insufficient rust prevention.

OBJECTS OF THE INVENTION

Taking the above-described problems into account, it is an object of the present invention to provide a mixed metallurgical powder which possesses a consistently effective rust preventing effect, and can maintain the rust preventing effect even after sintering.

Another object of the present invention is to provide a sintered compact formed of a rust-resistant mixed powder, and a method for the manufacture thereof.

A further object of the present invention is to provide a novel and unique technique for treating and/or handling powdered copper, or mixed powder containing copper, and for manufacturing sintered compacts, such as, electric devices or mechanical components, by sintering such powder.

SUMMARY OF THE INVENTION

In order to solve the above-described problems, the inventor of the present invention conducted repeated examinations, and found that powdered copper or mixed powder containing copper or a sintered compact produced therefrom could be obtained with high reproducibility while maintaining a stable rust preventing effect and manufacturing conditions, by mixing, containing or applying a low volatility metal that is relatively difficult to form alloys with the material powder comprising powdered copper, or mixed powder containing copper, in place of conventional organic corrosion preventing agents.

On the basis of the above-described findings, the present invention provides a mixed metallurgical powder containing powdered copper and 20–400 ppm by weight of Bismuth (Bi) in the form of powdered Bi. Preferably, the mixed powder contains 30–300 ppm by weight of Bi.

According to another aspect of the present invention, a sintered compact is provided which is made from powdered or solid copper and contains 20–400 ppm by weight of Bi, preferably, 30–300 ppm by weight of Bi.

According to another aspect of the present invention, a sintered compact is provided having an outermost surface, an outer layer defined as being within 1 $\mu$m from the outermost surface, and a remaining part of the sintered compact which is defined as the entire sintered compact minus the outer layer. The outer layer has a content of Bi which exceeds the Bi content in the remaining part of the sintered compact. Preferably, the Bi content in the outer layer is at least 10-fold of the Bi content of the remaining part of the sintered compact.

According to another aspect of the present invention, a method for manufacturing a sintered compact is provided in which a metallurgical powder is sintered. The powder contains powdered copper and 20–400 ppm by weight of Bi which is in the form of powdered Bi. The sintered compact is provided having an outermost surface, an outer layer defined as being within 1 μm from the outermost surface, and a remaining part of the sintered compact which is defined as the entire sintered compact minus the outer layer. Preferably, the outer layer has a content of Bi which is at least 10-fold the Bi content in the remaining part of the sintered compact, and preferably, the powder contains 30–300 ppm by weight of Bi.

According to another aspect of the present invention, a method for manufacturing a sintered compact is provided in which a metallurgical powder containing powdered copper is sintered under a Bi vapor pressure.

DETAILED DESCRIPTION OF THE PREFERRED EMBODIMENTS AND METHODS

The mixed metallurgical powder includes powdered copper as the main component and other optional supplemental components, such as graphite, which may be added thereto. In such a powder, 20–400 ppm by weight of bismuth (Bi) in the form of powdered Bi is added and mixed to form a material for powder metallurgy.

Powdered copper used herein is powder containing 50% by weight or more Cu. Powdered Bi used herein is powder containing 1% by weight or more Bi. The lower limit of the Bi content was determined to be 20 ppm by weight because little rust preventing effect is expected if the content of Bi is less than 20 ppm by weight.

An excessively high content of Bi is also not preferable because it lowers the properties provided by the copper, for instance, electrical conductivity or heat conductivity, and makes the sintered compact brittle, even if the rust preventing effect is improved. Therefore, it is preferable to limit the content of Bi to 400 ppm by weight or less.

Bi is harmless to human bodies, and thus, operators handling powdered Bi are not adversely affected by use of the Bi. Also, the Bi contained in the mixed metallurgical powder or sintered bodies does not contaminate the environment. Therefore, Bi is suitable as a material for use in powder metallurgy.

When powdered Bi is added to powdered copper and stirred, an alloy film is formed on the surface of powdered copper and significantly improves the corrosion resistance (oxidation resistance) even in the mixed powdered state. Since the mixed powder has corrosion resistance as described above, treatments utilizing corrosion preventing agents, such as benzotriazole, are not required, and problems of rust during handling does not occur. However, the use of organic corrosion preventing agents as described above is not precluded, that is, these corrosion preventing agents may be used in combination with the present invention.

Although the degree of mechanical alloying (surface alloying) depends on mixing and stirring time, a long mechanical alloying time is not required for the purposes of preventing rust.

Next, a mixed material comprising, or containing, powdered copper and Bi is used to form a compressed compact of a desired shape and is sintered at a temperature in the vicinity of 700–800° C.

For example, a sintered compact was formed by sintering compressed powdered copper containing 300 ppm of Bi, and then, the surface of the sintered compact was subjected to XPS analysis. The analysis showed that the Cu/Bi weight ratio on the outermost surface of the sintered compact had a content of Bi of at least 40%. However, when the outermost surface was etched off by about 20 nanometers (nm), the content of Bi in the Cu/Bi weight ratio lowered to 2% or less. Additively, at a depth of 1 mm, the content of Bi decreased to 0.n % or less and was not detected. From this example, it is shown that the surface of the sintered compact is covered with a Bi layer.

The Bi layer occurs because the Bi gasifies from the interior of a porous sintered compact of metallurgical powder and condenses on the surface thereof. Since the rust preventing effect provided by the Bi does not require internal diffusion, an effective rust preventing effect can be obtained by the presence of a very small quantity of Bi which condenses on the surface of the compact.

In particular, it is also effective for a sintered compact of metallurgical powder to have a Bi content on its outer layer that exceeds the Bi content of the entire remaining part of the sintered compact. For purposes of this application, the outer layer is defined as the part of the compact extending about 1 μm from the outermost surface of the compact, and the entire remaining part is the entire sintered compact minus the outer layer. Preferably, the Bi content of the outer layer is at least 10 times the Bi content of the remaining portion of the compact.

A metallic Bi film, or an alloy film, with Bi can also be formed on the surface of the sintered compact by sintering the metallurgical powder under the vapor pressure of Bi. Thus, this further improves the rust preventing effect of the Bi on the sintered compact. By this method, the rust preventing effect is imparted to the sintered compact without using powdered copper mixed with Bi.

As described above, since the rust preventing effect of the present invention is effective in the powder state, ie. the stage of mixed material powder, no special rust preventing treatment is required for storing, transporting, and handling the powder. Also, by sintering the mixed material powder as it is, a sintered compact having an improved rust preventing effect is obtained.

Hence, the present invention has the features of significantly enhancing rust prevention of the mixed material powder and the sintered compact, as well as facilitating treatment operations and reducing manufacturing costs.

EMBODIMENTS AND COMPARATIVE EXAMPLES

The present invention will be described in detail below referring to embodiments and comparative examples. These are merely embodiments of the present invention, and are not intended to limit in any way the present invention. Thus, the present invention is limited only by the attached claims and includes various modifications other than the embodiments described herein.

Embodiment 1 and Comparative Example 1

As Table 1 shows, 0–500 ppm of powdered Bi (Bi: 99.5% by weight or more, Toyo Metal Powder, −325 mesh) was added and mixed to powdered copper (Cu: 99.5% by weight or more, Nikko-Gouldfoil #52-H) which was free (1 ppm or less) of Bi.

After forming this Bi-added powdered copper into a compressed compact (about 8×10×60 mm) under a compressing pressure of 3 tons/cm$^2$ without using lubricants, the compressed compact was sintered at a sintering temperature of 700° C. for 120 minutes in an ammonia decomposition gas atmosphere ($N_2$:$H_2$=1:3).

This sintered compact was placed in a constant temperature, constant humidity vessel, and a humidity resistance oxidation test was performed in an atmosphere at a temperature of 80° C. and a relative humidity of 80% for 24 hours. The results are shown in Table 1.

As is obvious from Table 1, the sample to which Bi was not added (Comparative Example 1) discolored significantly. However, humidity oxidation resistance improved with an increase in the quantity of Bi added. Even the addition of Bi as little as 20 ppm by weight improved humidity oxidation resistance of the sintered compact which experienced only a little discoloration, and no problem arose in normal use.

Where especially high humidity oxidation resistance is required, the addition of 30 ppm by weight or more Bi is recommended. As described above, the quantity of Bi added to powdered copper is preferably 20 ppm by weight or more, and more preferably 30 ppm by weight or more.

TABLE 1

| | | Bi content (ppm) | Result of moisture and oxidation resistance test |
|---|---|---|---|
| Embodiment 1 | a | 20 | Slightly discolored |
| | b | 50 | Little discolored |
| | c | 100 | Not discolored |
| | d | 300 | Not discolored |
| | e | 500 | Not discolored |
| Comparative Example 1 | f | Not added | Significantly colored |

(ppm: wt)

Embodiment 2 and Comparative Example 2

As Table 2 shows 0–500 ppm of powdered Bi (Bi: 99.5% by weight or more, Toyo Metal Powder, −325 mesh) was added and mixed to powdered copper (Cu: 99.5% by weight or more, Nikko-Gouldfoil #52-H) free (1 ppm or less) of Bi.

After mixing the Bi-added powdered copper with graphite (Japan Grahite CB-150) in a 70%/30% ratio and forming this mixture into a green compact (10×10×60 mm) under a compacting pressure of 3 tons/cm$^2$, the compact was sintered at a sintering temperature of 700° C. for 150 minutes in an ammonia decomposition gas atmosphere ($N_2$:$H_2$=1:3).

The properties of the sintered brushes were measured. The results are shown in Table 2.

As apparent from Table 2, adding Bi had no effect or only a minimal effect with respect to sintered density and resistivity. However, transverse rupture strength tended to decrease with an increase in the quantity of added Bi. The transverse rupture strength of the embodiment having 500 ppm by weight of Bi was about 14% lower than the flexural strength of Comparative Example 2 which is without Bi.

In general, it has been known that a smaller quantity of Bi than the quantity of Pb exhibits hot shortness. Although it is not shown in Table 2, if the decrease of the transverse rupture strength is to be no greater than 10%, the quantity of Bi should be 400 ppm by weight or less. From the above result, the preferred maximum quantity of Bi added to powdered copper was determined to be 400 ppm by weight or less.

TABLE 2

| | | Bi content (ppm) | Green density (g/cm$^3$) | Sintered density (g/cm$^3$) | Resistivity ($\mu\Omega$-cm) | Transverse rupture strength (kg/cm$^2$) |
|---|---|---|---|---|---|---|
| Embodiment 2 | a | 20 | 4.16 | 4.07 | 27 | 181 |
| | b | 50 | 4.16 | 4.07 | 28 | 180 |
| | c | 100 | 4.17 | 4.07 | 29 | 178 |
| | d | 300 | 4.16 | 4.07 | 25 | 179 |
| | e | 500 | 4.15 | 4.06 | 26 | 159 |
| Comparative Example 2 | f | Not added | 4.16 | 4.07 | 27 | 184 |

(ppm: wt)

Comparative Example 3

Green compacts were made and sintered in the same manner as in Embodiment 1 except that each of powdered Sn, powdered Zn, and powdered In, were used in place of powdered Bi in a quantity of 500 ppm to form the green compacts. The sintered compacts were subjected to the humidity oxidation tests under the same humidity oxidation test conditions as in Embodiment 1.

The results showed that the surfaces of the sintered compacts were discolored to brown. These samples were obviously inferior in oxidation resistance, and the addition of powdered Sn, powdered Zn, and powdered In, was found to be ineffective.

Embodiment 3

Powdered Bi (Nippon Atomize, −200 mesh) at 300 ppm was added and mixed to powdered copper (Nikko-Gould foil #52-H) free (10 ppm or less) of Bi.

This mixed powdered copper was filled in a metal tray of about 150 mm×100 mm×25 mm, and three or four pure copper wires (2.5 mm dia.) polished with emery paper for a length of about 50 mm were placed into the surface of the powdered copper. The powdered copper was sintered as is at a sintering temperature of 700° C. for 120 minutes in an ammonia decomposition gas atmosphere ($N_2$:$H_2$=1:3).

The sintered product thus obtained was placed in a constant temperature and constant humidity vessel, and the humidity oxidation test was carried out by allowing the product to stand for 24 hours at a temperature of 80° C. and a relative humidity of 80%.

As a result, no oxidation film was observed on the surface of the sintered product. This was of course foreseeable from the result of Embodiment 1. However, no oxidation was also observed on the surface of the pure copper wire which did not contain Bi. Therefore, to clarify this result, XPS surface analysis was conducted on the surface of the pure copper wire.

As a result, several percent of Bi in the comparative ratio to copper was detected on the top surface of the pure copper. It has been determined that some of the Bi evaporated from the Bi powder of the mixed powdered copper compressed into the metal tray and relocated onto the pure copper wire. Thus, the Bi covered and alloyed onto the surface of the pure copper wire. In this manner it was confirmed that a trace of Bi can significantly enhance corrosion resistance of surfaces.

Comparative Example 4

Powdered copper (Nikko-Gould foil #52-H) was filled in a metal tray of about 150 mm×100 mm×25 mm without adding powdered Bi, and three or four pure copper wires (2.5 mm dia.) polished with emery paper for a length of about 50 mm were placed into the surface of the powdered copper. The powdered copper was sintered as is at a sintering temperature of 700° C. for 120 minutes in an ammonia decomposition gas atmosphere ($N_2$:$H_2$=1:3).

The sintered product thus obtained was placed in a constant temperature and constant humidity vessel, and the humidity oxidation test was carried out by allowing it to stand for 24 hours at a temperature of 80° C. and a relative humidity of 80%.

As a result, the surface of the sintered product and the surface of the pure copper wire were oxidized and discolored into brown. From the comparison of this result with Embodiment 3, it is seen that the presence of Bi improves oxidation resistance significantly, and that oxidation resistance is poor when Bi is not present.

Embodiment 4

A green compact containing powdered Bi prepared in the same way as the above-described Embodiment 1, and a green compact containing no powdered Bi prepared in the same way as the above-described Comparative Example 1 were simultaneously sintered at a sintering temperature of 700° C. for 120 minutes in an ammonia decomposition gas atmosphere ($N_2$:$H_2$=1:3). In this case, however, for minimizing the effect of the green compact containing powdered Bi, the green compact containing no powdered Bi was placed on the wind of the furnace gas stream when sintered.

Both sintered compacts thus obtained were placed in a constant temperature and constant humidity vessel, and the humidity oxidation test was carried out by allowing it to stand for 24 hours under the condition of a temperature of 80° C. and a relative humidity of 80%. As a result of the humidity oxidation test, the surface of the sintered compact of green compact containing powdered Bi was unchanged, and no oxidation was observed. The surface of the sintered compact of green compact containing no powdered Bi was only slightly oxidized and only slightly discolored.

From these results, it is considered that a slight amount of Bi evaporated from the green compact containing powdered Bi under sintering conditions and relocated onto the surface of the sintered compact of the green compact containing no powdered Bi and covered the surface of the sintered compact thinly thereby producing the rust preventing effect.

Comparative Example 5

A green compact containing powdered Zn prepared in the same way as Comparative Example 3, and a green compact containing no powdered Zn prepared in the same way as Comparative Example 1 were simultaneously sintered under the same conditions as in the above-described Embodiment 4, and subjected to the humidity oxidation resistance test under the same conditions as in the Embodiment 4. As a result, considerable oxidation and discoloration occurred in both the green compact containing powdered Zn and the green compact containing no powdered Zn. Also from the comparison with Comparative Example 5, it is shown that the presence of a small quantity of Bi as in Embodiment 4 is effective.

The mixed metallurgical powder comprises powdered copper as a main component. It is mixed with 20–400 ppm by weight, preferably 30–300 ppm by weight, of Bi in the form of powdered Bi for use as a material in powder metallurgy. The mixed material in powder form has significantly improved corrosion resistance. Therefore, a high quality mixed metallurgical powder can be maintained without being oxidized even in a corrosive environment in the processes of treatment, transportation, and storage.

Bi is harmless to human bodies, and no operators handling powdered Bi are adversely affected by Bi. Also, Bi contained in the mixed metallurgical powder or sintered compact does not contaminate the environment.

Furthermore, by compressing the mixed material comprising Bi and powdered copper or mixed powder containing powdered copper into a desired shape, and sintering the green compact at a temperature in the vicinity of 700–800° C., a sintered compact can be produced easily without special treatment, that is, using the above-described material powder in an as-is condition. The oxidation resistance of the sintered compact thus obtained is significantly improved, and a sintered material suitable for electrical parts such as brushes and for various mechanical parts can be obtained without adversely affecting required properties, such as electrical conductivity.

As described above, the present invention has features of remarkably enhancing the rust preventing effect of the mixed material powder as well as the sintered compact. In addition, the invention facilitates process operations, reduces manufacturing costs, and is environmentally friendly in that the added Bi is harmless to the environment and humans.

What is claimed is:

1. A mixed metallurgical powder comprising powdered copper and 20–400 ppm by weight of Bi in the form of powdered Bi.

2. A mixed metallurgical powder according to claim 1, wherein said mixed metallurgical powder contains 30–300 ppm by weight of Bi.

3. A sintered compact of metallurgical powder comprising a compacted material containing copper and 20–400 ppm by weight of Bi.

4. A sintered compact according to claim 3, wherein said copper is powdered copper.

5. A sintered compact according to claim 3, wherein said copper is solid copper.

6. A sintered compact according to claim 4, wherein said compacted material contains 30–300 ppm by weight of Bi.

7. A sintered compact of metallurgical powder comprising an outermost surface, an outer layer which is the outermost part of said sintered compact and extends to a depth of about 1 $\mu$m inward from said outermost surface, and a remaining part of said sintered compact which is the entire sintered compact minus said outer layer, said outer layer and said remaining part of said sintered compact each having a Bi content, and said Bi content of said outer layer exceeding said Bi content of said remaining part of said sintered compact.

8. A sintered compact according to claim 7, wherein said Bi content of said outer layer is at least ten times the Bi content of said remaining part of said sintered compact.

9. A method for manufacturing a sintered compact of metallurgical powder comprising the steps of mixing metallurgical powder containing powdered copper with 20–400 ppm by weight of Bi in the form of powdered Bi and thereafter sintering said mixed metallurgical powder and Bi.

10. A method for manufacturing a sintered compact according to claim 9, wherein 30–300 ppm by weight of Bi is mixed with said powdered copper.

11. A method according to claim 10, wherein said sintered compact is formed with an outermost surface, an outer layer which is the outermost part of said sintered compact and extends to a depth of about 1 $\mu$m inward from said outermost surface, and a remaining part of said sintered compact which is the entire sintered compact minus said outer layer; wherein said outer layer and said remaining part of said sintered compact are formed each having a Bi content, and wherein said Bi content of said outer layer is at least ten-times said Bi content of said remaining part of said sintered compact.

12. A method for manufacturing a sintered compact of metallurgical powder comprising the steps of sintering a material powder containing a powdered copper under a Bi vapor pressure.

* * * * *